US012655555B2

(12) United States Patent
Mori

(10) Patent No.: US 12,655,555 B2
(45) Date of Patent: Jun. 16, 2026

(54) SEWING MACHINE PROVIDED WITH ADJUSTING MECHANISM FOR ADJUSTING PRESSING FORCE APPLIED TO WORKPIECE

(71) Applicant: BROTHER KOGYO KABUSHIKI KAISHA, Nagoya (JP)

(72) Inventor: Hiroki Mori, Anjo (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 18/970,214

(22) Filed: Dec. 5, 2024

(65) Prior Publication Data

US 2025/0207311 A1 Jun. 26, 2025

(30) Foreign Application Priority Data

Dec. 20, 2023 (JP) ..... 2023-215147

(51) Int. Cl.
*D05B 29/02* (2006.01)

(52) U.S. Cl.
CPC ..... *D05B 29/02* (2013.01)

(58) Field of Classification Search
CPC ..... D05B 29/02; D05B 29/12; D05B 29/06
See application file for complete search history.

(56) References Cited

U.S. PATENT DOCUMENTS

| | | | | | |
|---|---|---|---|---|---|
| 2,139,426 | A | * | 12/1938 | Toskey | D05B 29/02 112/237 |
| 2,836,137 | A | * | 5/1958 | Ayres | D05B 29/02 112/237 |
| 3,759,202 | A | * | 9/1973 | Jean-Blanc | D05B 29/02 112/239 |
| 4,292,907 | A | * | 10/1981 | Gilbride | D05B 29/02 112/236 |
| 4,724,783 | A | * | 2/1988 | Morimoto | D05B 27/22 112/311 |

FOREIGN PATENT DOCUMENTS

| | | | |
|---|---|---|---|
| JP | S56-35379 | U | 4/1981 |
| JP | 2001-187288 | A | 7/2001 |
| JP | 2019-130121 | A | 8/2019 |
| JP | 2019-162284 | A | 9/2019 |

* cited by examiner

*Primary Examiner* — Patrick J. Lynch
(74) *Attorney, Agent, or Firm* — Oliff PLC

(57) ABSTRACT

The sewing machine includes a sewing machine motor, a needle plate, a feed dog, a presser bar, a presser bar holder, an adjustment portion, a presser spring, a restriction portion, and a change member having a first member and a second member. In a first period in which a feed dog upper end is above a plate upper surface and the adjustment portion is spaced apart from the restriction portion, the adjustment portion contacts with the presser bar holder to cause the urging force of the presser spring to be transmitted to the presser bar. In a second period in which the feed dog upper end is beneath the plate upper surface and the adjustment portion contacts with the restriction portion, the adjustment portion is spaced apart from the presser bar holder to prevent the urging force of the presser spring from being transmitted to the presser bar.

11 Claims, 10 Drawing Sheets

SEWING MACHINE PROVIDED WITH ADJUSTING MECHANISM FOR ADJUSTING PRESSING FORCE APPLIED TO WORKPIECE

REFERENCE TO RELATED APPLICATIONS

This application claims priority from Japanese Patent Application No. 2023-215147 filed on Dec. 20, 2023. The entire content of the priority application is incorporated herein by reference.

BACKGROUND ART

The present disclosure relates to a sewing machine.

A presser device of a sewing machine according to known art includes a connecting member, a moving member, and an elastic member. The connecting member is connected to a sewing machine drive shaft and oscillates. The moving member moves in the up-down direction with the oscillation of the connecting member. The elastic member is arranged between the moving member and a presser bar. The elastic member changes the elastic force applied to the presser bar according to the movement of the moving member. The presser device moves the moving member such that the urging force of the elastic member becomes greater when the upper end of a feed dog is positioned above a needle plate than when the upper end of the feed dog is positioned below the needle plate. As a result, the presser device changes the urging force applied to a presser foot arranged on the lower end of the presser bar in synchronization with the rotation of the sewing machine drive shaft. With this sewing machine, the user can adjust the initial setting of the pressing force applied to the sewing object by the presser foot in order to accommodate changes in the thickness and hardness of the sewing object.

SUMMARY

With the presser device of the sewing machine according to the known art, the mechanism for changing the pressing force applied to a sewing object by the presser foot in synchronization with the rotation of the sewing machine motor is complex. With the presser device of the sewing machine according to the known art, the adjustment operation for adjusting, in accordance with the sewing object, the timing for changing the urging force applied to the presser foot is complicated.

Embodiments of the broad principles derived herein provide a sewing machine that contributes to adjusting, in accordance with a sewing object, the timing for changing the urging force applied to a presser foot in synchronization with the rotation of the sewing machine motor by a simpler operation than that of the known art.

Embodiments provide a sewing machine that includes a sewing machine motor, a needle bar, a needle plate, a feed dog, a presser bar, a presser bar holder, an adjustment portion, a presser spring, a restriction portion, and a change member. The needle bar has a lower end on which a sewing needle is mountable. The needle bar is configured to be driven by the sewing machine motor to move in an up-down direction. The needle plate has a plate upper surface, a needle hole, and an opening. The plate upper surface is an upper surface of the needle plate. The sewing needle is configured to pass through the needle hole. The feed dog is configured to be driven by the sewing machine motor to move in the up-down direction through the opening to feed a sewing object placed on the needle plate. The feed dog has a feed dog upper end. The feed dog upper end is an upper end of the feed dog. The presser bar has a lower end on which a presser foot is mountable. The presser bar is configured to move in the up-down direction in synchronization with movement of the feed dog. The presser bar holder is fixed to the presser bar. The adjustment portion is configured to move in the up-down direction. The presser spring is configured to urge the presser bar downward via the adjustment portion and the presser bar holder. The restriction portion is configured to restrict transmission of urging force from the presser spring to the presser bar when the restriction portion contacts with the adjustment portion. The change member has a first member, and a second member supported to be movable with respect to the first member. The change member is configured to change a position of the restriction portion in the up-down direction according to a distance between the first member and the second member. In a first period in which the feed dog upper end is above the plate upper surface and the adjustment portion is spaced apart from the restriction portion, the adjustment portion contacts with the presser bar holder contact to cause the urging force of the presser spring to be transmitted to the presser bar. In a second period in which the feed dog upper end is beneath the plate upper surface and the adjustment portion contacts with the restriction portion, the adjustment portion is spaced apart from the presser bar holder in the up-down direction to prevent the urging force of the presser spring from being transmitted to the presser bar. The sewing machine contributes to adjusting the timing for switching whether the urging force of the presser spring is transmitted to the presser bar or not by a relatively simple operation of changing the distance between the first member and the second member. Therefore, the sewing machine contributes to simplifying, compared to the known art, the operation of adjusting, in accordance with the sewing object, the timing for changing the urging force applied to the presser foot mounted to the lower end of the presser bar in synchronization with the rotation of the sewing machine motor.

DESCRIPTION

Figure 1:
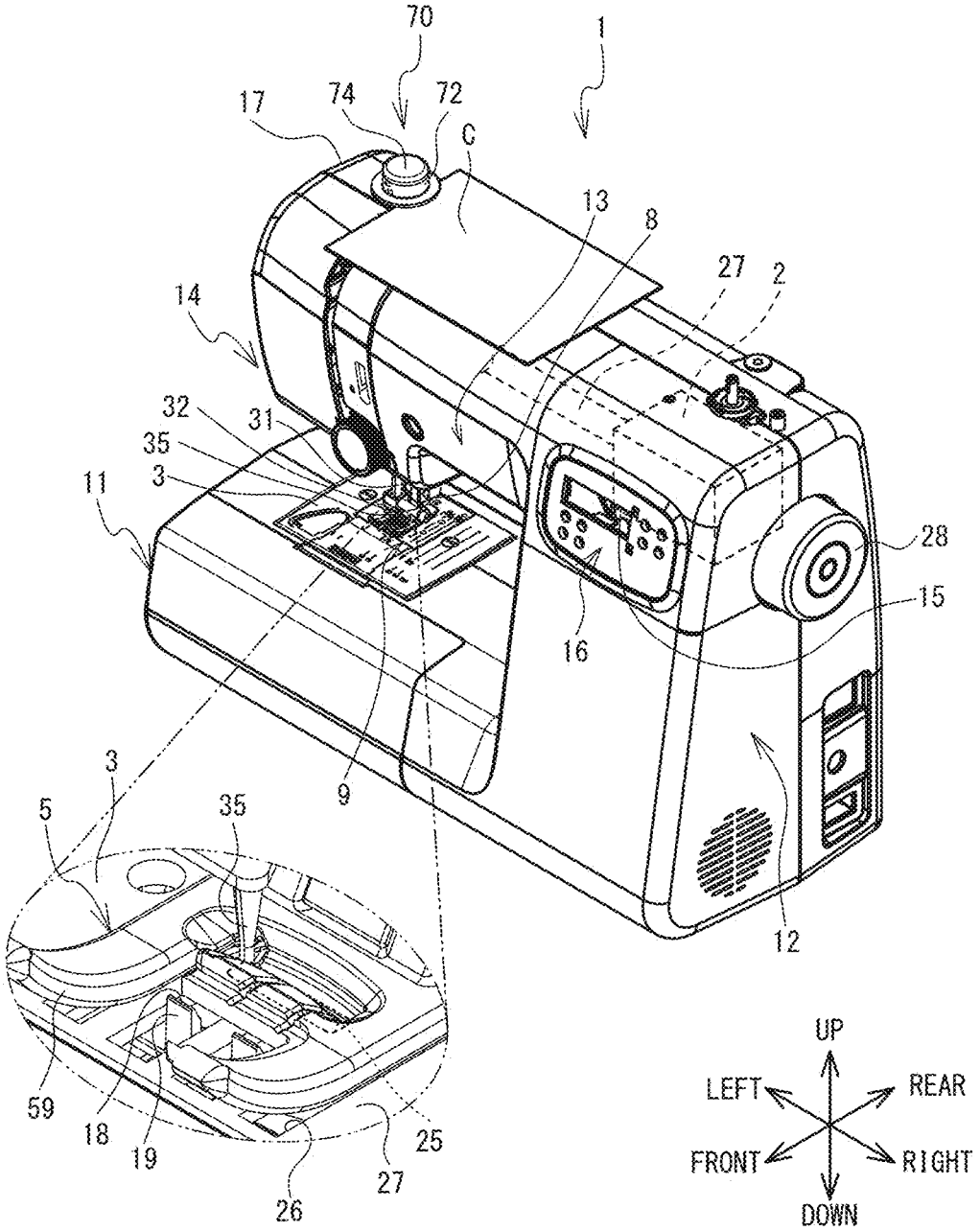
FIG. 1 is a perspective view of a sewing machine.

An embodiment of the present disclosure will be described below with reference to the drawings. The physical configuration of a sewing machine 1 will be described with reference to FIG. 1 to FIG. 9B. The sewing machine 1 of the present embodiment has functions for facilitating curved line sewing by mechanically changing the pressing force applied to a presser foot 5 at a predetermined timing while a needle bar 31 of the sewing machine 1 moves back and forth once in the up-down direction. The sewing machine 1 is configured to easily switch the pressing force applied to the presser foot 5 between a pressing force suitable for curved line sewing and a pressing force suitable for normal straight stitching. The up-down direction, the lower right direction, the upper left direction, the lower left direction, and the upper right direction in FIG. 1 are, respectively, the up-down direction, the right direction, the left direction, the front direction, and the rear direction of the sewing machine 1 with a presser device 9 attached. The direction in which a pillar 12 extends is the up-down direction of the sewing machine 1. The direction in which an arm 13 and a bed 11 extend from the pillar 12 is the left direction.

Figure 6:
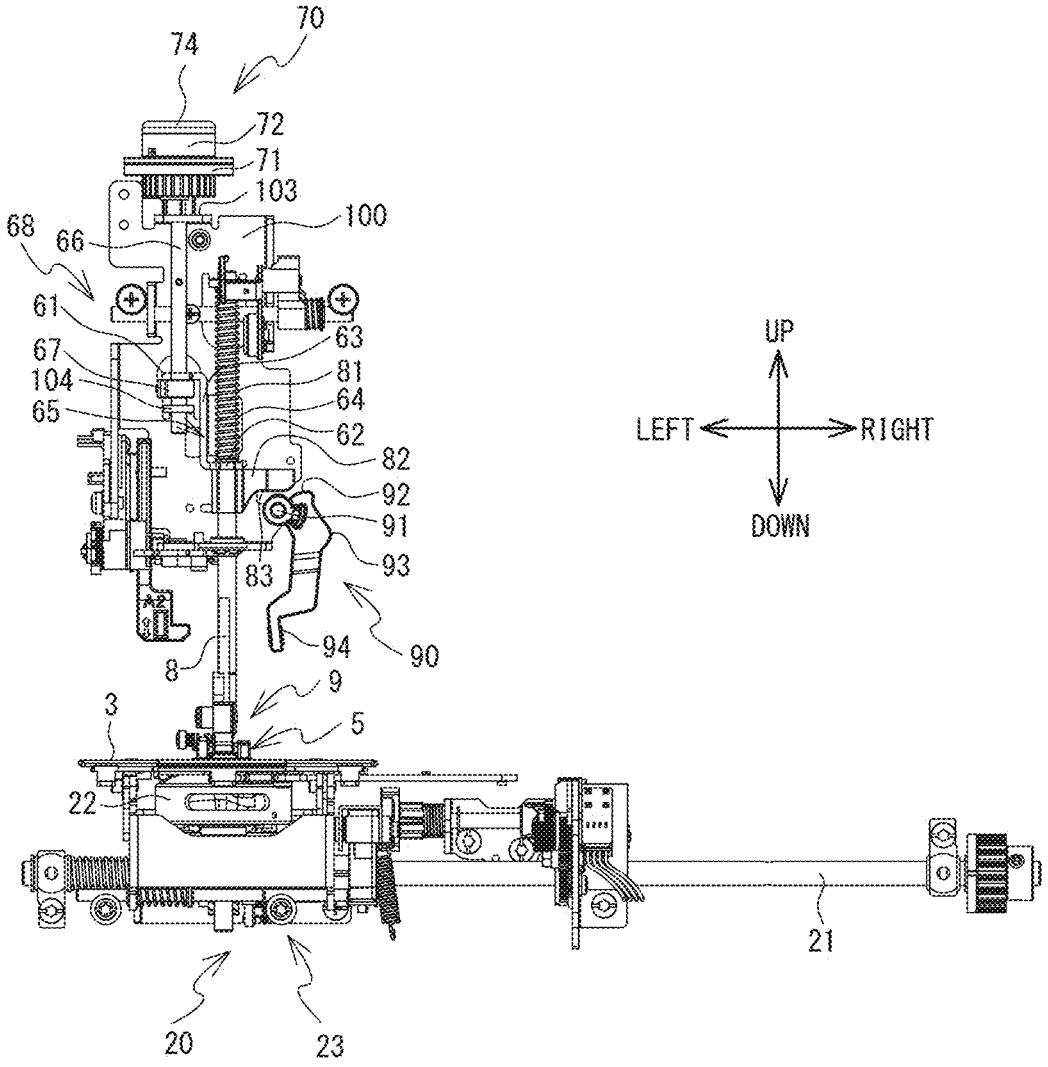
FIG. 6 is a front view of the change member and the adjustment mechanism with the presser bar, the presser bar holder, and the restriction portion arranged in a reference position.
Figure 7:
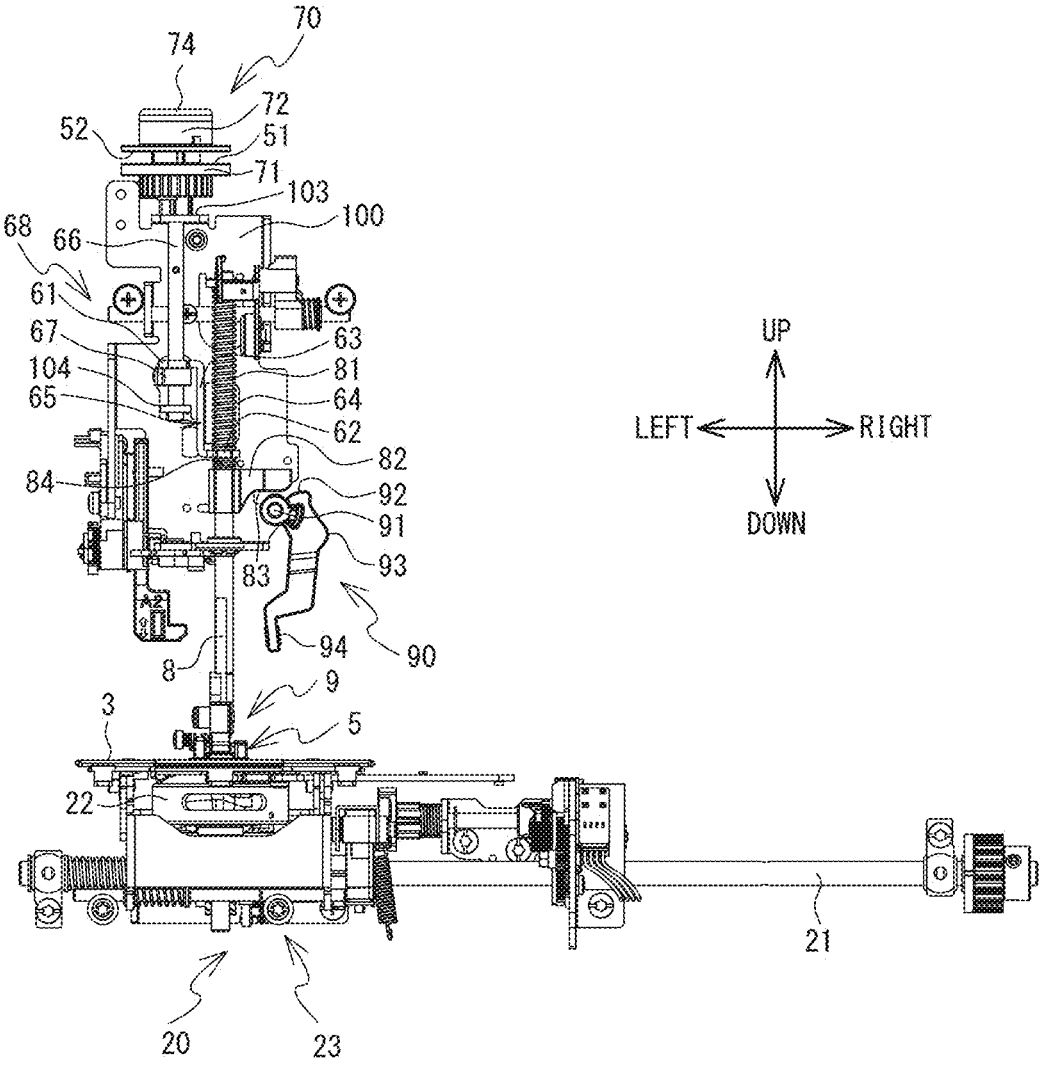
FIG. 7 is a front view of the change member and the adjustment mechanism with the restriction portion moved to a position 4 mm above the reference position.

As shown in FIG. 1, the sewing machine 1 includes the bed 11, the pillar 12, the arm 13, and a head 14. The bed 11 is the base of the sewing machine 1 that extends in the left-right direction, and includes a needle plate 3. The needle plate 3 is arranged on an upper surface of the bed 11. The needle plate 3 has a plate shape that extends horizontal, and has arranged therein, a needle hole 25 through which a sewing needle 35, to be described later, passes, and an opening 26 extending in the front-rear direction. The bed 11 includes a feed dog 19, a shuttle mechanism 20 shown in FIG. 6, and a feed mechanism 23 below the needle plate 3. A feed dog upper end 18, which is the upper end of the feed dog 19, is configured to be driven by the sewing machine motor 2 to appear from and be retracted beneath the opening 26 arranged in the needle plate 3, and feed a sewing object C that has been placed on the needle plate 3. The feed mechanism 23 is configured to convey the sewing object C rearward or forward by driving the feed dog 19 in response to the driving of a sewing machine motor 2, described later. The feed dog 19 is configured to be driven by the sewing machine motor 2 to move in the up-down direction through the opening 26 to feed the sewing object C placed on the needle plate 3. As shown in FIG. 6, the shuttle mechanism 20 includes a lower shaft 21 and a horizontal shuttle 22. The horizontal shuttle 22 rotates in response to the rotation of the lower shaft 21 to entwine an upper thread with a lower thread, below the needle plate 3.

As shown in FIG. 1, the pillar 12 stands upright from the right end portion of the bed 11. The sewing machine motor 2 is arranged inside the upper portion of the pillar 12. An LCD 15 is arranged on a front surface of the pillar 12. A switch 16 is arranged below the LCD 15. A pulley 28 is arranged on the right side of the pillar 12.

Figure 2A:
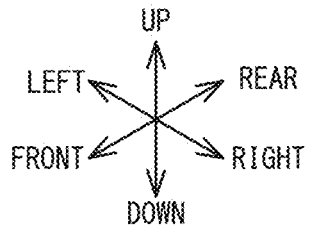
FIG. 2A is a perspective view of a presser bar, a presser bar holder, an adjustment mechanism, and a change member in a first condition in which a first wall of an adjustment portion and a restriction portion are contacted in the up-down direction
Figure 2B:
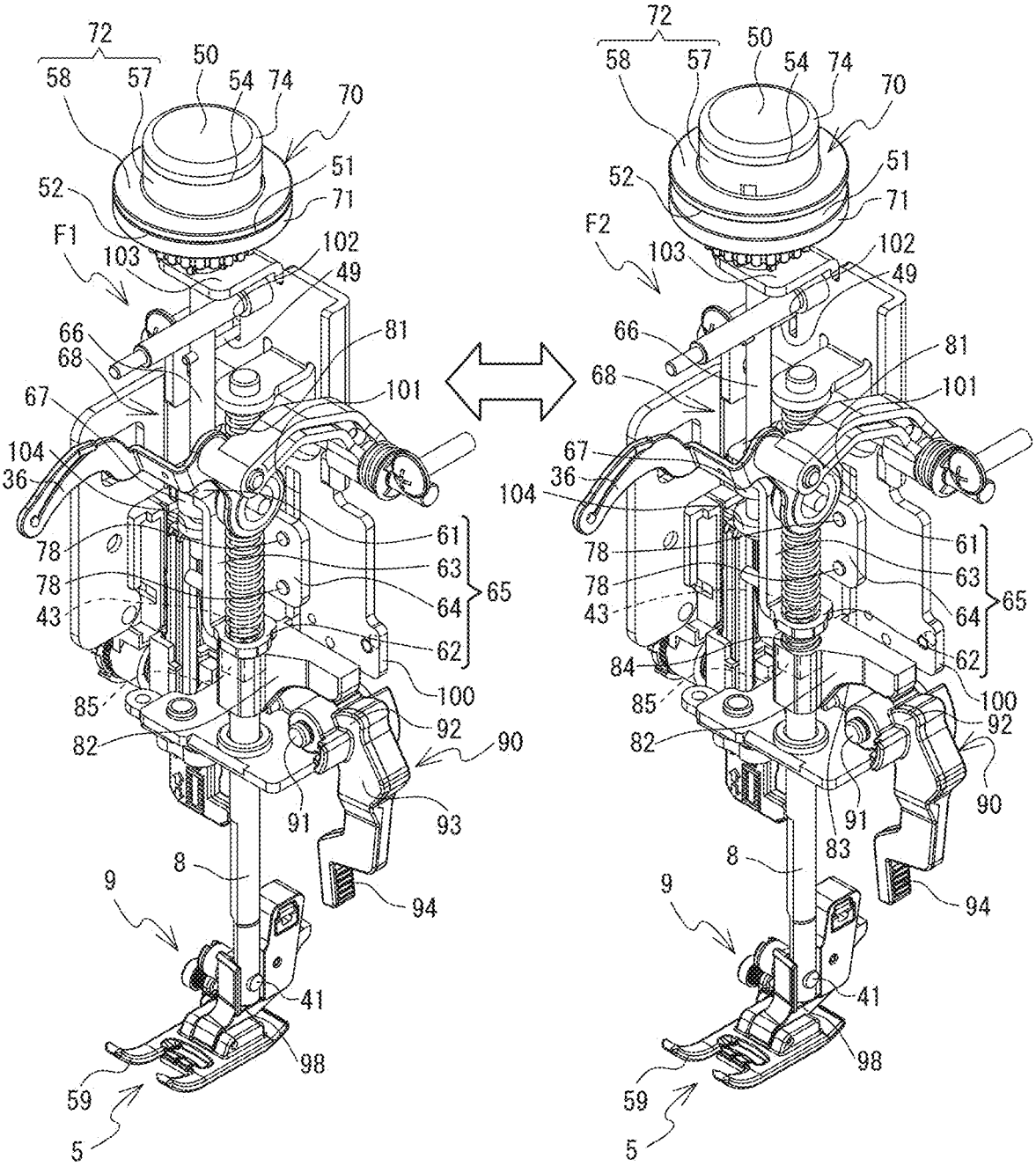
FIG. 2B is a perspective view of the presser bar, the presser bar holder, the adjustment mechanism, and the change member in a second condition in which the first wall of the adjustment portion and the restriction portion are separated in the up-down direction.

The arm 13 extends to the left from the upper end of the pillar 12, facing the bed 11. The head 14 is a portion connected to the left tip end of the arm 13. As shown in FIG. 1 and FIG. 2A, the head 14 includes a thread take-up lever 36, the needle bar 31, a needle bar mechanism, a presser bar 8, and an adjustment mechanism 68, and the like. The thread take-up lever 36 is configured to take up the upper thread entwined with the lower thread by the shuttle in response to the driving of the sewing machine motor 2. The needle bar 31 has a lower end 32 on which the sewing needle 35 is mountable. The needle bar 31 is configured to move in the up-down direction in response to the driving of the sewing machine motor 2. A needle holder is fixed to the lower end 32 of the needle bar 31. The needle holder removably holds the sewing needle 35. The needle bar mechanism is configured to move the needle bar 31 in the up-down direction in response to the driving of the sewing machine motor 2. The needle bar 31 also moves in the up-down direction when the pulley 28 is rotated by a user.

Figure 3A:
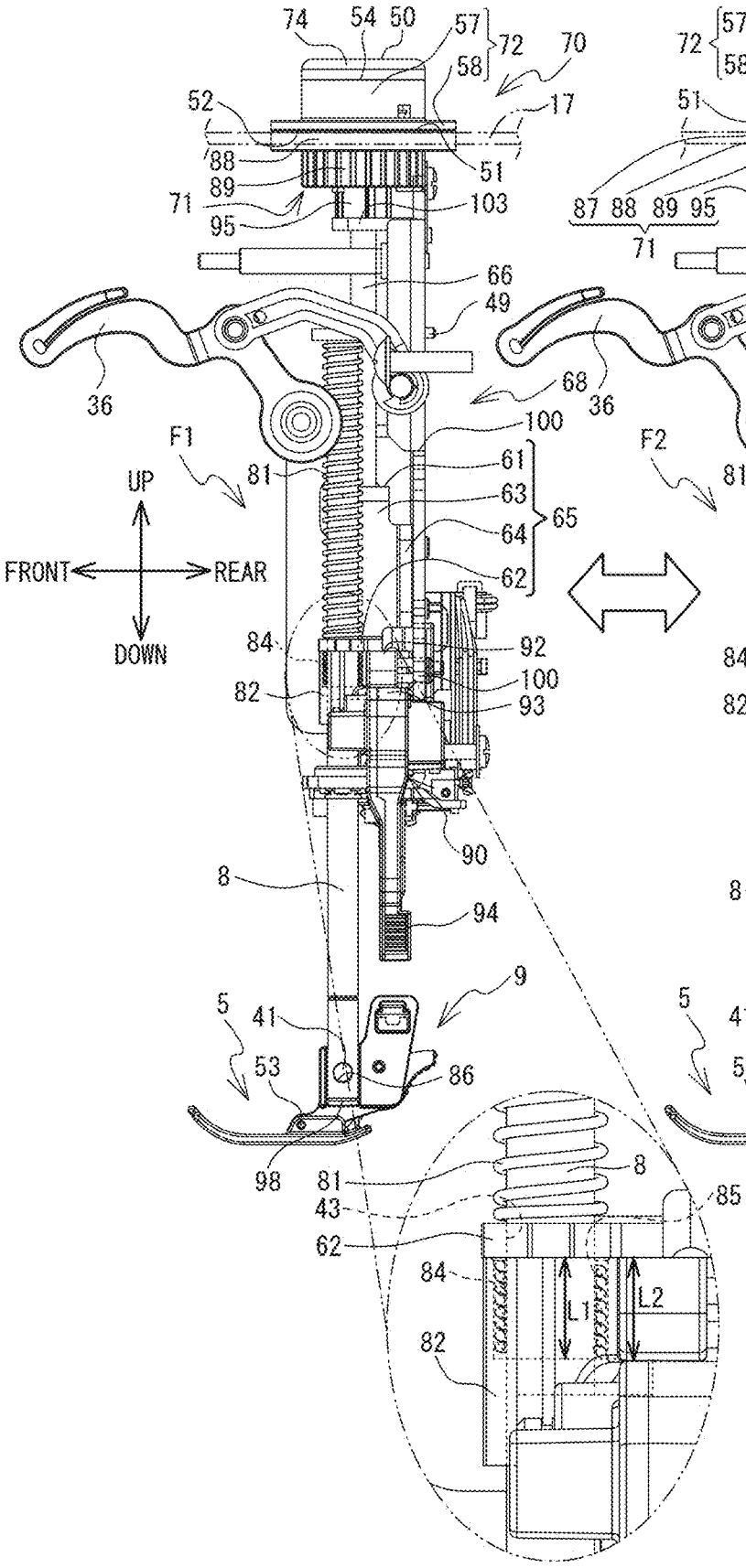
FIG. 3A is a right side view of the presser bar, the presser bar holder, the adjustment mechanism, and the change member in the first condition.

The presser bar 8 extends in the up-down direction to the rear of the needle bar 31. The presser bar 8 is configured to move in the up-down direction in synchronization with the driving of the sewing machine motor 2, or more specifically, feed dog 19. As shown in FIG. 2A, the presser bar 8 includes a presser spring 81, a presser bar holder 82, and a lever 90. The presser spring 81 is a coil spring fitted over the outside of the presser bar 8. The presser bar holder 82 is fixed to the presser bar 8 and contacts the lower end of the presser spring 81 to define the lower end position of the presser spring 81. The presser spring 81 is configured to urge the presser bar 8 downward via an adjustment portion 65 and the presser bar holder 82. As shown in FIG. 3A, the presser bar holder 82 has a housing portion 85 recessed downward by a first length L1 from the upper surface of presser bar holder 82. The housing portion 85 houses the lower end portion of an adjustment spring 84. The adjustment spring 84 applies a smaller urging force than the presser spring 81. The adjustment spring 84 of the present embodiment is a coil spring. The adjustment spring 84 is housed in the housing portion 85 with the presser bar 8 inserted therethrough. In the up-down direction, the lower end of the adjustment spring 84 is defined by the bottom surface of the housing portion 85. The upper end of the adjustment spring 84 is defined by an adjustment portion 65, described later, arranged above the presser bar holder 82.

Figure 8:
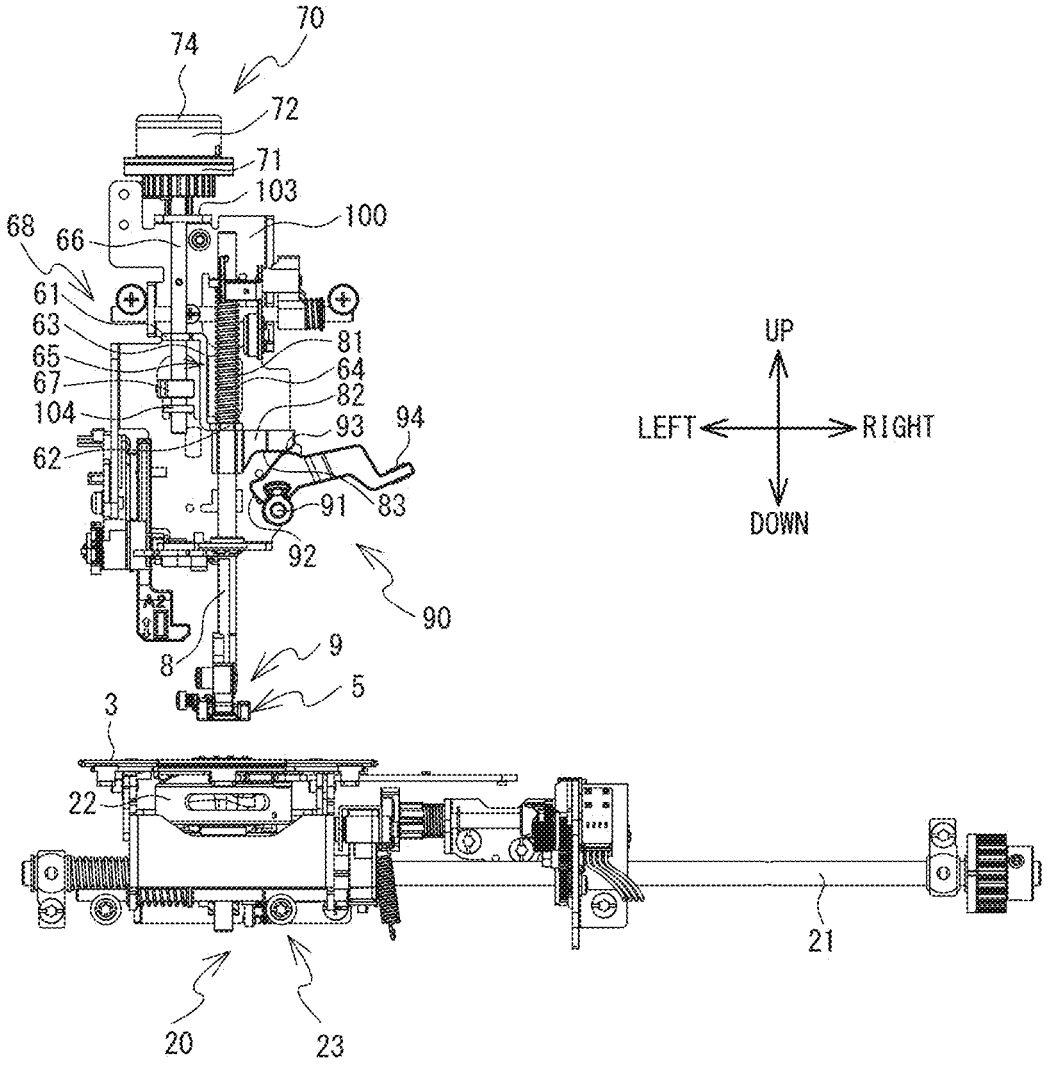
FIG. 8 is a front view of the presser bar, the presser bar holder, the adjustment mechanism, and the change member in a state with a protrusion portion of a lever contacting with the presser bar holder.

As shown in FIG. 2A, the lever 90 manually switches the position of the presser bar 8 in the up-down direction. The lever 90 includes a shaft portion 91, protrusion portions 92 and 93, and an operating portion 94. The shaft portion 91 is arranged inside the head 14. The protrusion portions 92 and 93 are portions that protrude away from the shaft portion 91 near the shaft portion 91. The operating portion 94 is a portion farthest away from the shaft portion 91. The user can switch the presser bar 8 between a raised position and a lowered position by operating the operating portion 94 with a finger or other operating body to rotate the lever 90 in the clockwise direction or the counterclockwise direction when viewed from the front around the shaft portion 91. FIG. 2A to FIG. 7 show a state in which the operating portion 94 is disposed below the shaft portion 91 and the presser bar 8 is in the lowered position. When the operating portion 94 is rotated in the counterclockwise direction when viewed from the front from the state shown in FIG. 6 such that the operating portion 94 is disposed to the upper right of the shaft portion 91, the protrusion portion 93 of the lever 90 contacts with a lower surface 83 of the presser bar holder 82 and moves the presser bar 8 to the raised position. FIG. 8 shows a state in which the operating portion 94 is disposed to the upper right of the shaft portion 91, and the presser bar 8 is in the raised position. The user can perform the work of arranging the sewing object C or taking the sewing object C away while the presser bar 8 is disposed in the raised position.

As shown in FIG. 3A, a hole 86 is arranged that passes through the lower end portion of the presser bar 8 in the left-right direction. The presser device 9 is configured to be removably mounted to the lower end portion of the presser bar 8 with a screw 41 inserted through the hole 86. The presser device 9 supports the presser foot 5 in a state enabling the presser foot 5 to pivot around a shaft 53 extending in the left-right direction. The presser foot 5 has a rectangular plate shape that is long in the front-rear direction when viewed from above. The front end portion and the rear end portion of the presser foot 5 each curve upward. As shown in FIG. 1, a notch 59 is arranged in the front portion of the presser foot 5. When the presser device 9 that supports the presser foot 5 is mounted to the lower end 98 of the presser bar 8 and the sewing machine 1 is driven, the sewing needle 35 is inserted through the rear end portion of the notch 59. When the presser bar 8 is in the lowered position, the presser foot 5 contacts the sewing object C that has been placed on the needle plate 3, and presses the sewing object C downward. The sewing machine 1 of the present embodiment is configured to switch whether to change the pressing force transmitted to the presser foot 5 while the needle bar 31 of the sewing machine 1 moves back and forth once in the up-down direction, by operating a change member 70 of the adjustment mechanism 68, described later.

Figures 5A, 5B:
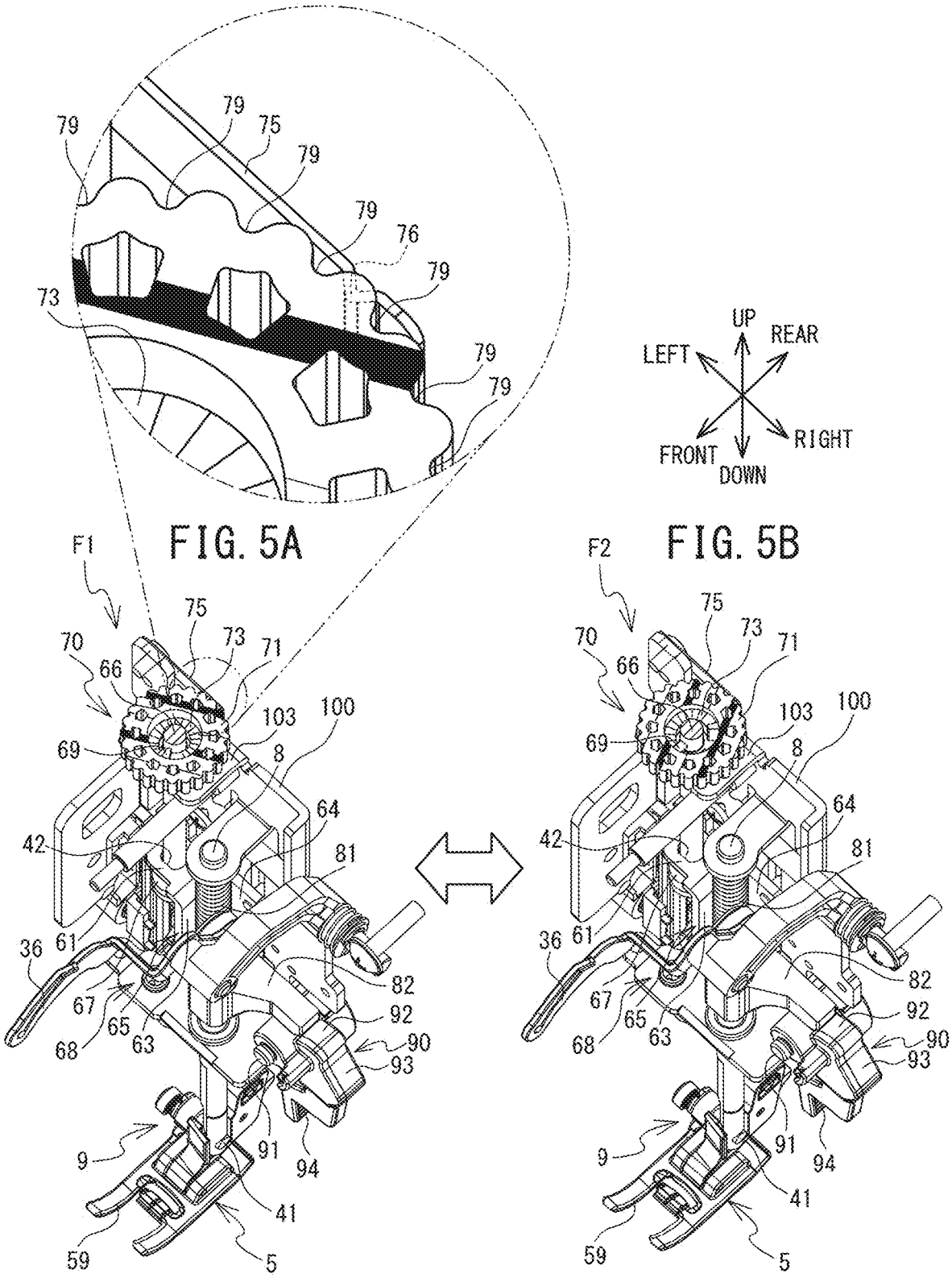
FIG. 5A is perspective view of the presser bar, the presser bar holder, the adjustment mechanism, and the change member in the first condition.
FIG. 5B is a perspective view of the presser bar, the presser bar holder, the adjustment mechanism, and the change member in the second condition.

As shown in FIG. 2A and FIG. 5A, the adjustment mechanism 68 includes the adjustment portion 65, a restriction portion 67, and the change member 70. The adjustment portion 65 is configured to move in the up-down direction and defines the lower end of the presser spring 81 and the upper end of the adjustment spring 84. The adjustment portion 65 is formed by bending a metal plate, for example. The adjustment portion 65 has a plate shape with a first insertion portion 42 through which a change shaft 66 of the change member 70, described later, is inserted and a second insertion portion 43 through which the presser bar 8 is inserted. The adjustment portion 65 includes a first wall 61, a second wall 62, a third wall 63, and a fourth wall 64. The first wall 61 has a plate shape that extends horizontally to the left of the presser bar 8. The first insertion portion 42 is arranged in the first wall 61. The first insertion portion 42 is a circular hole when viewed from above, which passes through the first wall 61 in the up-down direction. The first wall 61 defines the lower end of the movement range of the adjustment portion 65 by contacting with the restriction portion 67. The second wall 62 is arranged below the first wall 61 and has a plate shape that extends horizontally to the right of the first wall 61. The second insertion portion 43 is arranged in the second wall 62. The second insertion portion 43 is a circular hole when viewed from above, which passes through the second wall 62 in the up-down direction, and through which the presser bar 8 is inserted. The third wall 63 connects the first wall 61 to the second wall 62 in the up-down direction. The third wall 63 has a plate shape that extends in the up-down direction to the left of the presser bar 8, and connects the right end portion of the first wall 61 to the second wall 62. The first wall 61, the second wall 62, and the third wall 63 of the adjustment portion 65 have a Z-shaped crank shape when viewed from the front.

Figure 4A:
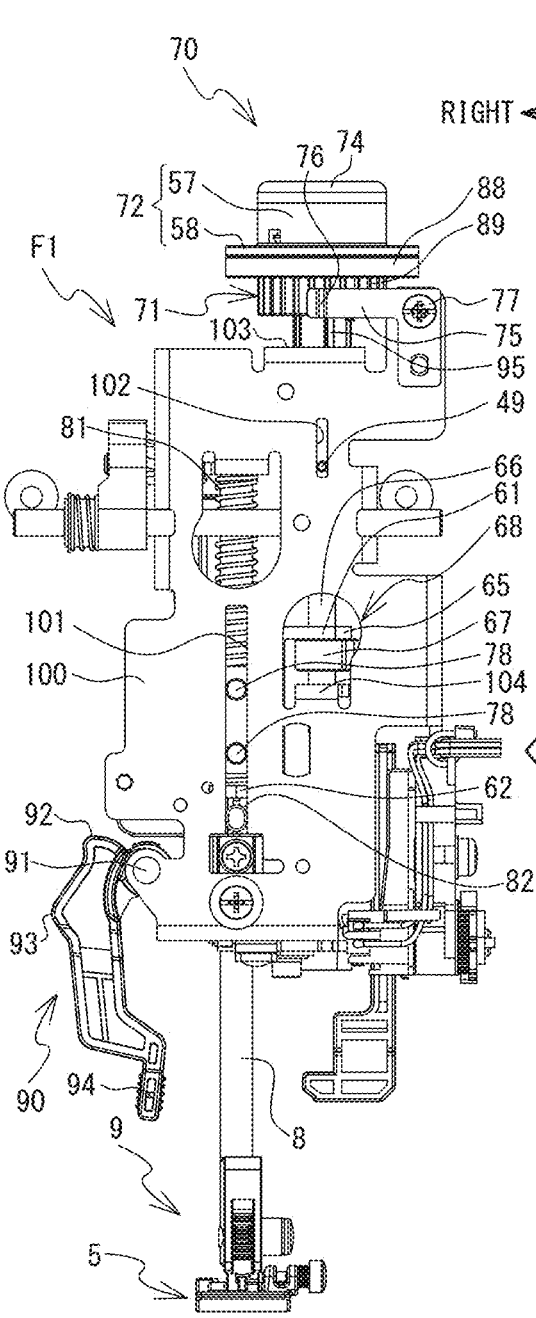
FIG. 4A is a back view of the presser bar, the presser bar holder, the adjustment mechanism, and the change member in the first condition.

The fourth wall 64 connects to the third wall 63 and extends parallel to the presser bar 8. The fourth wall 64 extends to the right from the rear end portion of the third wall 63. In the left-right direction, the left end portion of the fourth wall 64 is positioned to the left of the presser bar 8, and the right end portion of the fourth wall 64 is positioned to the right of the presser bar 8. As shown in FIG. 2A and FIG. 4A, the fourth wall 64 has a pair of pins 78 protruding to the rear. The pair of pins 78 are aligned the up-down direction. A plate-shaped portion 100 that extends parallel to the fourth wall 64 is provided to the rear of the fourth wall 64. The extension range in the up-down direction and the left-right direction of the plate-shaped portion 100 is larger than the extension range in the up-down direction and the left-right direction of the fourth wall 64. Slits 101 and 102 that extend in the up-down direction and pass through in the front-rear direction are arranged in the plate-shaped portion 100. The slit 101 is arranged rearward of the presser bar 8. The pair of pins 78 are inserted through the slit 101 of the plate-shaped portion 100. The slit 101 guides the movement of the adjustment portion 65 in the up-down direction. The slit 102 is arranged rearward of the change shaft 66 and above the slit 101. The plate-shaped portion 100 further has insertion portions 103 and 104 with holes which pass through in the up-down direction. Each of the insertion portions 103 and 104 is a portion formed by bending the plate-shaped portion 100 forward, and the change shaft 66 is inserted through the holes. A restricting member 75 is fixed by a screw 77 to the upper left portion of the plate-shaped portion 100. The restricting member 75 is a plate spring that extends in the left-right direction. The right end portion of the restricting member 75 has a protrusion portion 76 that protrudes forward. The protrusion portion 76 is a portion where the plate spring has been bent in a V-shape when viewed from above.

As shown in FIG. 2A, the restriction portion 67 restricts the transmission of urging force from the presser spring 81 to the presser bar 8 when the restriction portion 67 contacts with the adjustment portion 65. The restriction portion 67 has a cuboid shape and is fixed to the lower end portion of the change shaft 66. The restriction portion 67 is arranged below the first wall 61 of the adjustment portion 65, and is configured to restrict the movement range of the adjustment portion 65 by detachably contacting with the lower surface of the first wall 61.

As shown in FIG. 2A to FIG. 5B, the change member 70 has the change shaft 66, a first member 71, a second member 72, a contact-receiving portion 73, a first stopper 45, a second stopper 46, and a cap 74. The change shaft 66 has a shaft shape that extends parallel to the presser bar 8 to the left of the presser bar 8 and supports the adjustment portion 65 so as to allow the adjustment portion 65 to move in the up-down direction. The change shaft 66 is inserted through the first insertion portion 42 of the first wall 61. The change shaft 66 includes a contact portion 69 and a shaft 49. As shown in FIG. 5A, the contact portion 69 is arranged on the upper end portion of the change shaft 66 and has a bar shape that extends perpendicular to the change shaft 66. The contact portion 69 extends forward from the change shaft 66. The shaft 49 is arranged below the contact portion 69 and has a shaft shape that extends perpendicular to the change shaft 66. As shown in FIG. 4A, the shaft 49 extends to the rear from the change shaft 66 and is inserted through the slit 102. The slit 102 guides the movement of the change shaft 66 in the up-down direction and restricts the change shaft 66 from rotating about an axis extending in the up-down direction.

Figure 3B:
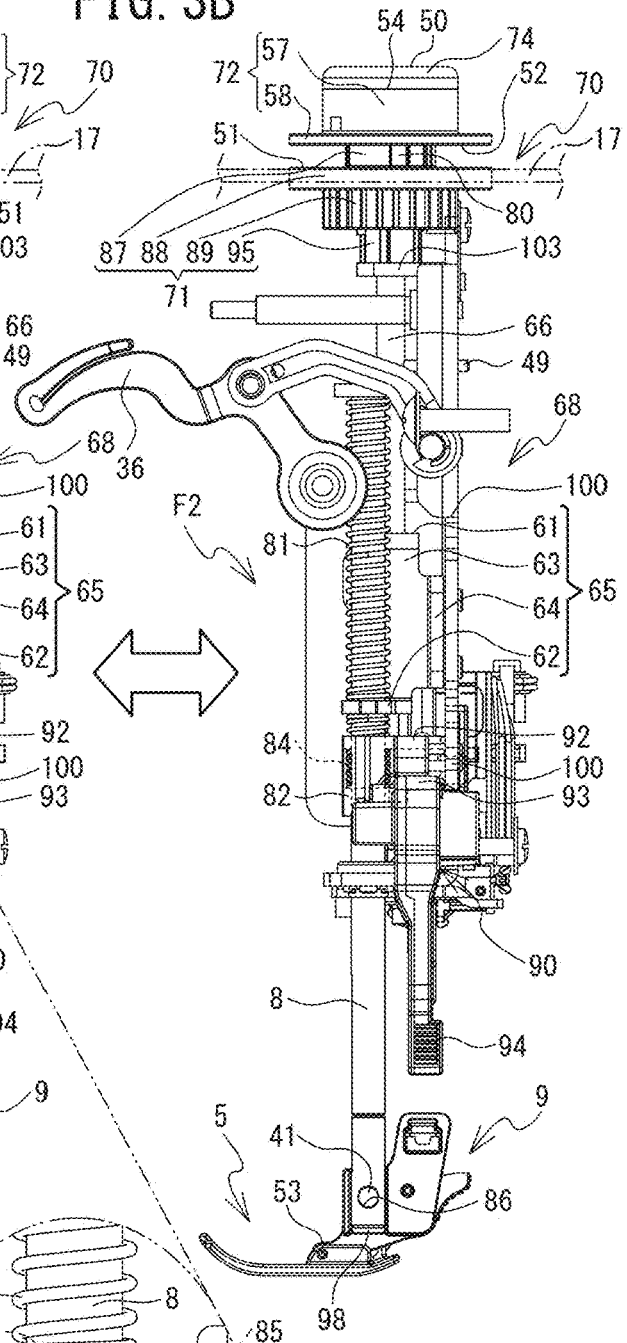
FIG. 3B is a right side view of the presser bar, the presser bar holder, the adjustment mechanism, and the change member in the second condition.

The first member 71 has a first surface 51 that extends horizontally orthogonal to the up-down direction. The first surface 51 is exposed outside a cover 17. The vertical position of the first surface 51 in the present embodiment is substantially the same as the vertical position of the upper surface of the cover 17 of the sewing machine 1. A portion of the upper surface of the cover 17 that is adjacent to the first surface 51 in the left-right direction, which is the longitudinal direction of the arm 13, extends horizontally parallel to the first surface 51. The change shaft 66 extends parallel to the presser bar 8 and connects to the restriction portion 67. The first member 71 has a hole 56 that passes through in the up-down direction and through which the change shaft 66 is inserted. The first member 71 is a portion having a disc shape when viewed from above, and the first member 71 is placed around the change shaft 66. The first member 71 has a cylindrical portion 87, a flange 88, a dial 89, and a cylindrical portion 95. As shown in FIG. 3B, a recessed portion 80 that extends in the up-down direction and is recessed toward the change shaft 66 is arranged on the outer circumference of the cylindrical portion 87. The flange 88 protrudes horizontally from the lower end of the cylindrical portion 87. The outer circumference of the flange 88 is circular when viewed from above.

The dial 89 has a smaller diameter than the flange 88. The dial 89 has, on the outer peripheral portion thereof, a plurality of recessed portions 79 that are recessed toward the change shaft 66 and extend in the up-down direction. One of the plurality of recessed portions 79 of the first member 71 disengageably meshes with the protrusion portion 76 of the restricting member 75 arranged rearward the change member 70. The restricting member 75 restricts rotational movement of the first member 71 and fixes the change member 70 at an appropriate position. The cylindrical portion 95 extends cylindrically downward from the dial 89. The diameter of the cylindrical portion 95 is shorter than the diameter of the cylindrical portion 87.

The first member 71 has the contact-receiving portion 73 with which the contact portion 69 is configured to contact. The contact-receiving portion 73 is configured to change the position of the restriction portion 67 in the up-down direction by changing the contact position where the contact portion 69 contacts with the contact-receiving portion 73. As shown in FIG. 5A, the contact-receiving portion 73 is a cam surface of an end surface cam that extends included in a spiral shape around the change shaft 66 along the inner circumference of the second member 72. The contact-receiving portion 73 is configured to contact with the contact portion 69 of the change shaft 66. The lower end of the cylindrical portion 95 of the first member 71 contacts with the upper surface of an insertion portion 103 of the plate-shaped portion 100. The first member 71 is sandwiched in the up-down direction by the contact portion 69 of the change shaft 66 and the insertion portion 103 of the plate-shaped portion 100. Therefore, the position of the first member 71 in the up-down direction is a fixed position.

Figure 9A:
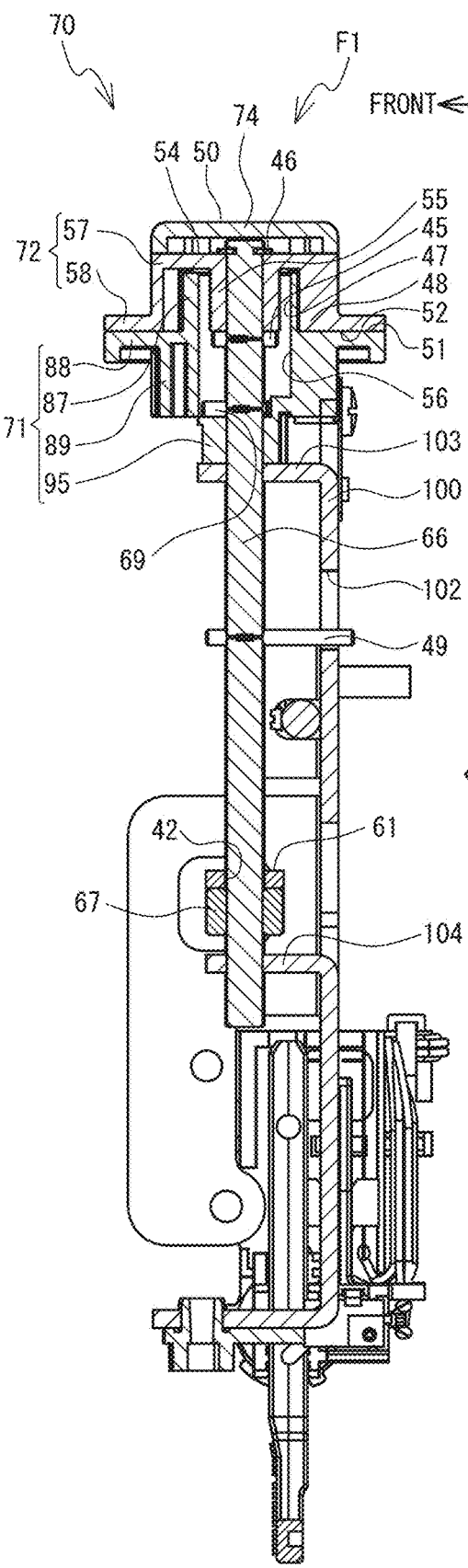
FIG. 9A is a sectional view of the change member in the first condition.
Figure 9B:
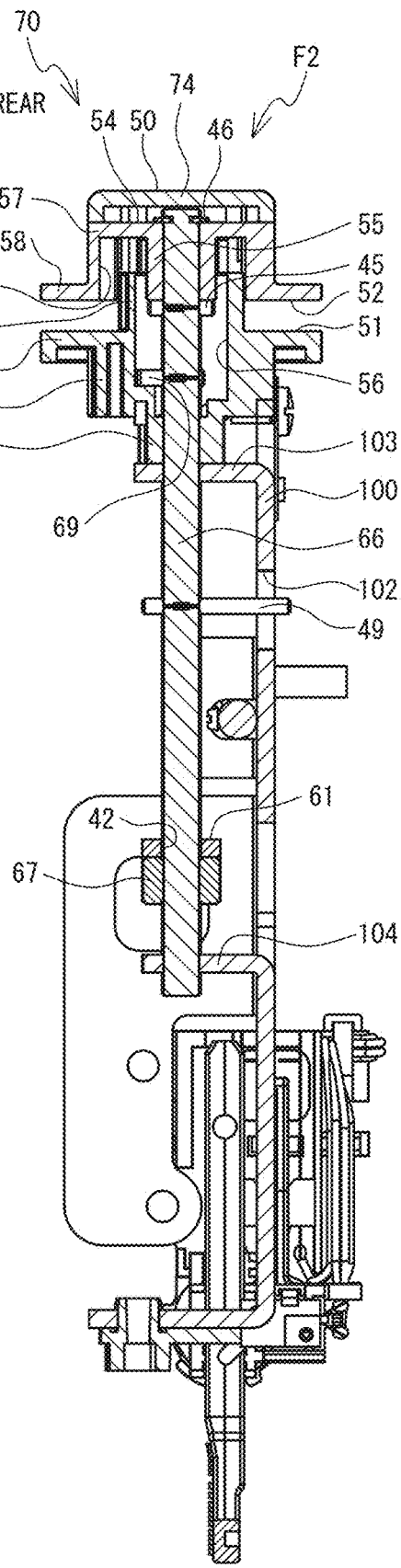
FIG. 9B is a sectional view of the change member in the second condition.

As shown in FIG. 2A to FIG. 5B, the second member 72 has a cylindrical shape with a hole 55 that passes through in the up-down direction, through which the change shaft 66 is inserted. The second member 72 has a cylindrical portion 57 and a flange 58 that protrudes horizontally from the lower end of the cylindrical portion 57. The second member 72 is supported by the change shaft 66 to be movable with respect to the first member 71. The second member 72 is able to move in the up-down direction. The second member 72 is exposed outside the cover 17. The second member 72 has a second surface 52 facing the first surface 51. The second surface 52 extends horizontally. The second surface 52 is the lower surface of the second member 72. The surface area of the second surface 52 is larger than the surface area of an upper surface 54 of the second member 72. The second surface 52 is the lower surface of the flange 58. The upper surface 54 is the upper surface of the cylindrical portion 57. The surface area of the second surface 52 is larger than the surface area of an upper surface 50 of the cap 74 that covers the upper surface 54 of the second member 72. The diameter of the outer circumference of the second surface 52 is larger than the diameter of the outer circumference of the upper surface 54. The diameter of the outer circumference of the second surface 52 is the same as the diameter of the outer circumference of the flange 88 of the first member 71. As shown in FIG. 9A and FIG. 9B, a recessed portion 47 that is recessed upward and has a circular shape when viewed from the bottom is arranged on the second surface 52. A protrusion portion 48 that protrudes toward the hole 55 is arranged on the outer periphery of the recessed portion 47. The protrusion portion 48 extends in the up-down direction. The cylindrical portion 87 of the first member 71 fits into the recessed portion 47. The protrusion portion 48 engages with the recessed portion 80 arranged in the cylindrical portion 87 of the first member 71. Therefore, the second member 72 rotates around the change shaft 66 together with the first member 71.

As shown in FIG. 9A and FIG. 9B, the first stopper 45 is a pin that is inserted through the change shaft 66 below the second member 72. The second stopper 46 is fixed above the first stopper 45. The second stopper 46 fixes the second member 72 with respect to the change shaft 66 in the up-down direction by squeezing, together with the first stopper 45, the second member 72. The second stopper 46 of the present embodiment is a retaining ring. The second stopper 46 fits over the change shaft 66 and contacts with the upper surface 54 of the second member 72 from above. The second member 72 is arranged in a manner able to rotate with respect to the change shaft 66 by being squeezed by the first stopper 45 and the second stopper 46.

Figure 4B:
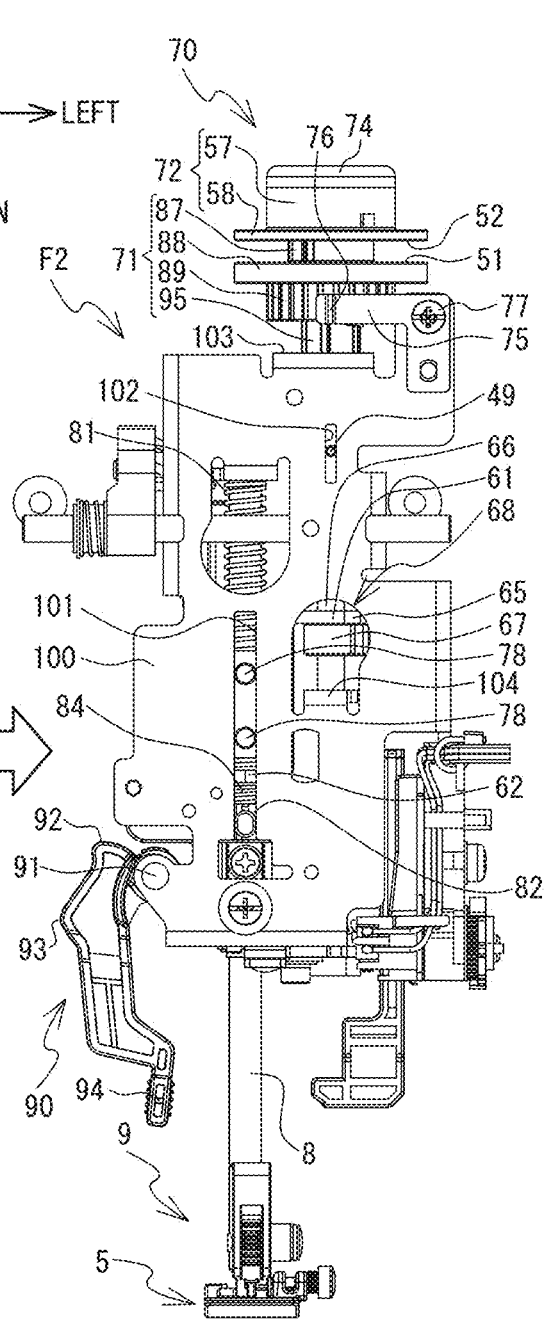
FIG. 4B is a back view of the presser bar, the presser bar holder, the adjustment mechanism, and the change member in the second condition.

As shown in FIG. 4A and FIG. 4B, the restriction portion 67 is configured to move in the up-down direction in response to movement of the second member 72 in the up-down direction. The restriction portion 67 moves in the up-down direction together with the change shaft 66 in response to rotation of the second member 72. The restriction portion 67 moves in the up-down direction by the amount of movement of the second member 72 in the up-down direction. The cap 74 covers the second member 72 from above. The cap 74 disengageably engages with the second member 72 and is configured to rotate together with the second member 72.

The change member 70 is configured to change the position of the restriction portion 67 in the up-down direction according to the distance between the first member 71 and the second member 72. More specifically, the change member 70 changes the position of the restriction portion 67 in the up-down direction according to the distance between the first surface 51 and the second surface 52 in the up-down direction. The change member 70 functions as a dial configured to rotate around the change shaft 66 when viewed from above. More specifically, when changing the position of the restriction portion 67 in the up-down direction, the user operates the second member 72 of the change member 70 that is exposed outside the cover 17 of the sewing machine 1. The user may also remove the cover 17 of the sewing machine 1 and operate the first member 71. The user arranges the sewing object C between the first surface 51 of the first member 71 and the second surface 52 of the second member 72, and rotates the second member 72 to make the second surface 52 contact the upper surface of the sewing object C. When the first member 71 is rotated, the second member 72 also rotates together with the first member 71. Because the shaft 49 of the change shaft 66 is inserted through the slit 102, the change shaft 66 will not rotate in response to the rotation of the change member 70. At this time, the portion of the contact-receiving portion 73 that contacts with the contact portion 69 changes, such that the position of the contact portion 69 in the up-down direction changes. In this way, the contact portion 69 moves in the up-down direction according to the position, in the up-down direction, of the portion of the contact-receiving portion 73 with which the contact portion 69 contacts. The change shaft 66 moves in the up-down direction while being guided by the slit 102, in response to the user rotating the change member 70.

In this way, the contact-receiving portion 73 is configured to change the position, in the up-down direction, of the restriction portion 67 fixed to the lower end portion of the change shaft 66, by changing the contact position where the contact portion 69 contacts with the contact-receiving portion 73. The lower end of the movable range of the restriction portion 67 is restricted by the insertion portion 104 through which the change shaft 66 is inserted, below the restriction portion 67. The rotating positions of the first member 71 and the second member 72 are fixed by the protrusion portion 76 meshing with one of the plurality of recessed portions 79 arranged on the lower end portion of the first member 71. In this way, the vertical position of the restriction portion 67 changes to a position corresponding to the thickness of the sewing object C. The user removes the sewing object C from between the first member 71 and the second member 72 and places the sewing object C on the needle plate 3 to form a stitch in the sewing object C. Accordingly, the sewing machine 1 is configured to form a stitch in the sewing object C in a condition where the vertical position of the restriction portion 67 has been adjusted according to the thickness of the sewing object C.

The positions of the presser bar holder 82 and the presser bar 8 in the up-down direction change according to the position of the feed dog 19 in the up-down direction in a condition where the presser bar holder 82 and the lever 90 are separated in the up-down direction. The presser device 9, by the change member 70 being operated, adjusts the position of the restriction portion 67 in the up-down direction to a position where the first wall 61 of the adjustment portion 65 contacts with the restriction portion 67 while the needle bar 31 of the sewing machine 1 moves back and forth once in the up-down direction. When the first wall 61 of the adjustment portion 65 contacts with the restriction portion 67 while the needle bar 31 of the sewing machine 1 moves back and forth once in the up-down direction, such that the adjustment portion 65 is not able to move downward any more, the second wall 62 of the adjustment portion 65 and the presser bar holder 82 are separated in the up-down direction so the urging force of the presser spring 81 is no longer transmitted to the presser bar holder 82. The urging force of the adjustment spring 84 is transmitted to the presser bar holder 82.

A case in which the position of the restriction portion 67 in the up-down direction is changed in a condition where the presser bar 8 is arranged in the lowered position will now be described with reference to FIG. 2A to FIG. 7. As shown in FIG. 2A, FIG. 3A, FIG. 4A, FIG. 5A, FIG. 6, and FIG. 9A, when pressing force applied to the presser foot 5 is a pressing force suitable for normal sewing, the user sets a first condition F1 where the restriction portion 67 is arranged at a reference position in a condition where the feed dog upper end 18 of the feed dog 19 is above the needle plate 3 and the sewing object C is not arranged between the needle plate 3 and the presser foot 5. In this first condition F1, the presser bar holder 82 is separated from the lever 90 in the up-down direction and contacting with the second wall 62 of the adjustment portion 65. In the first condition F1, the adjustment spring 84 is in its most compressed state in the up-down direction, and a second length L2 of the adjustment spring 84 in the up-down direction is equal to or less than the first length L1, in the up-down direction, of the housing portion 85 housing the lower end portion of the adjustment spring 84. When the sewing object C is arranged between the needle plate 3 and the presser foot 5 and sewing is performed in the first condition F1, urging force from the presser spring 81 is constantly transmitted to the presser foot 5 while the needle bar 31 of the sewing machine 1 moves back and forth once in the up-down direction.

As shown in FIG. 2B, FIG. 3B, FIG. 4B, and FIG. 5B, FIG. 7, and FIG. 9B, when the pressing force applied to the presser foot 5 is a pressing force suitable for curved line sewing, the user sets a second condition F2 that raises the restriction portion 67 above the reference position by an amount corresponding to the thickness of the sewing object C by operating the change member 70 from the first condition F1. The amount corresponding to the thickness of the sewing object C is 4 mm, for example. In the second condition F2, the presser bar holder 82 separates from the lever 90 in the up-down direction, and also separates from the second wall 62 of the adjustment portion 65 in the up-down direction. In the second condition F2, when arranging the sewing object C of a thickness of 4 mm between the needle plate 3 and the presser foot 5 and performing sewing, urging force from the presser spring 81 is transmitted to the presser foot 5 during the period when the restriction portion 67 and the first wall 61 of the adjustment portion 65 are separated in the up-down direction while the needle bar 31 of the sewing machine 1 moves back and forth once in the up-down direction. Meanwhile, urging force from the presser spring 81 is not transmitted to the presser foot 5, but instead, urging force from the adjustment spring 84 is transmitted to the presser foot 5 during the period when the restriction portion 67 and the first wall 61 of the adjustment portion 65 are contacting in the up-down direction. The user can change the pressing force applied to the sewing object C while the needle bar 31 of the sewing machine 1 moves back and forth once in the up-down direction by operating the change member 70 according to the thickness of the sewing object C to adjust the position of the restriction portion 67 in the up-down direction.

A case in which the presser bar 8 is arranged in the raised position will now be described with reference to FIG. 8. As shown in FIG. 8, from the state of the first condition F1 shown in FIG. 6, when the lever 90 is operated such that the protrusion portion 93 of the lever 90 is contacted with the presser bar holder 82, the presser bar holder 82 and the presser bar 8 are pushed upward by the protrusion portion 93 such that the presser foot 5 separates from the needle plate 3 in the up-down direction. In this state, the user performs the work of arranging the sewing object C between the needle plate 3 and the presser foot 5 and performs the work of attaching or removing the presser device 9 to or from the lower end 98 of the presser bar 8.

Figure 10:
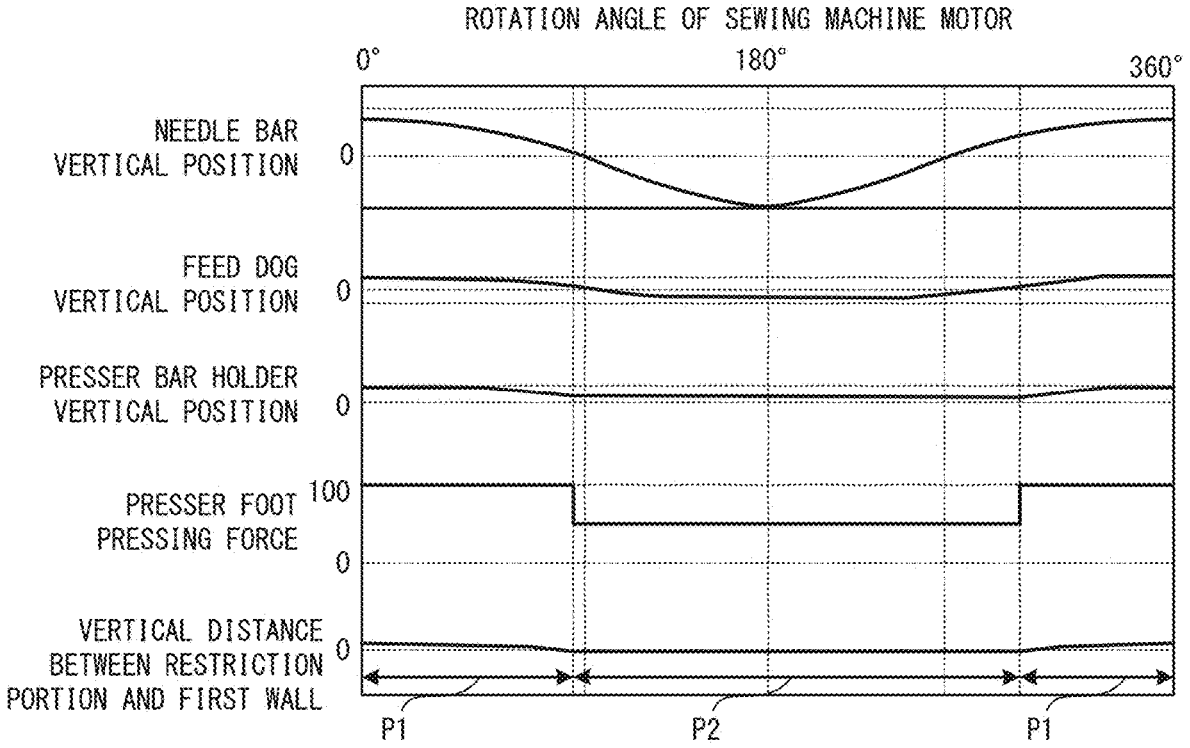
FIG. 10 is an explanatory view of the position of a needle bar in the up-down direction, the position of a feed dog in the up-down direction, the position of the presser bar holder in the up-down direction, the pressing force applied to a sewing object by a presser foot, and distance in the up-down direction between the restriction portion and the first wall of the adjustment portion depending on the rotation angle of the sewing machine motor.

The relationships among the vertical position of the needle bar 31, the vertical position of the feed dog 19, the vertical position of the presser bar holder 82, the pressing force applied by the presser foot 5 to the sewing object C, and the distance between the restriction portion 67 and the first wall 61 of the adjustment portion 65, depending on the rotation angle of the sewing machine motor 2 will be described with reference to FIG. 10. With the sewing machine 1 of the present embodiment, one rotation of the sewing machine motor 2 causes the needle bar 31 of the sewing machine 1 to move back and forth once in the up-down direction. With the "presser foot pressing force" in FIG. 10, the minute amount of change due to the amount of displacement of the presser spring 81 and the minute amount of change due to the amount of displacement of the adjustment spring 84 following the movement of the feed dog 19 in the up-down direction are ignored. FIG. 10 shows the pressing force applied to the presser foot 5 during a period P2, with the value of the pressing force applied to the presser foot 5 during a period P1 as 100. The period P1 is a period during which the first wall 61 of the adjustment portion 65 and the restriction portion 67 are separated in the up-down direction. The period P2 is a period during which the first wall 61 of the adjustment portion 65 and the restriction portion 67 are contacting in the up-down direction. The pressing force applied to the presser foot 5 during the period P2 is less than the pressing force applied to the presser foot 5 during the period P1. During the period P2, the presser bar holder 82 is lowered to a position where the presser foot 5 contacts with the sewing object C, downward with respect to the second wall 62 of the adjustment portion 65 by the urging force of the adjustment spring 84. As a result, the second wall 62 and the presser bar holder 82 separate in the up-down direction. During the period P1, the presser foot 5 is brought up by the feed dog 19 such that the presser bar 8 is pushed upward. As a result, the presser bar holder 82 moves upward against the urging force of the adjustment spring 84, and contacts with the second wall 62 in the up-down direction. Because the adjustment portion 65 can move upward, the presser bar holder 82 moves upward together with the adjustment portion 65 that has the second wall 62.

That is to say, in a first period, the adjustment portion 65 contacts with the presser bar holder 82 to cause the urging force of the presser spring 81 to be transmitted to the presser bar 8. In the first period, the feed dog upper end 18 is above a plate upper surface 27 that is the upper surface of the needle plate 3, and the adjustment portion 65 is separated from the restriction portion 67. With the first period, the sewing needle 35 is positioned above the sewing object C. That is to say, the sewing machine 1 applies the pressing force of the presser spring 81 to the presser foot 5 during the period when the sewing object C is being conveyed in the conveyance direction by the feed dog 19. As a result, the sewing machine 1 contributes to stably conveying the sewing object C in the conveyance direction with the sewing object C firmly sandwiched in the up-down direction by the presser foot 5 and the feed dog 19.

On the other hand, in a second period, the adjustment portion 65 is spaced apart from the presser bar holder 82 in the up-down direction to prevent the urging force of the presser spring 81 from being transmitted to the presser bar 8. In the second period, the feed dog upper end 18 is beneath the plate upper surface 27, and the adjustment portion 65 contacts with the restriction portion 67. The second period includes a period during which the sewing needle 35 is stuck into the sewing object C. As a result, the sewing machine 1 is able to reduce, compared to conventional sewing machines, the force applied to the presser foot 5 during the period P2 when the sewing needle 35 is stuck into the sewing object C. Therefore, the sewing machine 1 can, compared to conventional sewing machines, make it easier to change the orientation of the sewing object C during sewing with respect to the needle plate 3, and thus make it easier for the user to sew curved portions.

The sewing machine 1 of the above-described embodiment includes the sewing machine motor 2, the needle bar 31, the needle plate 3, the feed dog 19, the presser bar 8, the presser bar holder 82, the adjustment portion 65, the presser spring 81, the restriction portion 67, and the change member 70. The needle bar 31 has the lower end 32 on which the sewing needle 35 is mountable. The needle bar 31 is configured to be driven by the sewing machine motor to move in the up-down direction. The needle plate 3 has the plate upper surface 27, the needle hole 25 through which the sewing needle 35 is inserted, and the opening 26. The plate upper surface 27 is the upper end of the needle plate 3. The feed dog 19 is configured to be driven by the sewing machine motor to move the up-down direction through the opening 26 to feed the sewing object C placed on the needle plate 3. The feed dog 19 has the feed dog upper end 18. The feed dog upper end 18 is the upper end of the feed dog 19. The presser bar 8 has a lower end 98 on which the presser foot 5 attached is mountable. The presser bar 8 is configured to move in the up-down direction in synchronization with the driving of the feed dog 19. The presser bar holder 82 is fixed to the presser bar 8. The adjustment portion 65 is configured to move in the up-down direction. The presser spring 81 is configured to urge the presser bar 8 downward via the adjustment portion 65 and the presser bar holder 82. The restriction portion 67 restricts the transmission of urging force from the presser spring 81 to the presser bar 8 when the restriction portion 67 contacts with the adjustment portion 65. The change member 70 has the first member 71, and the second member 72 that is supported so as to be able to move relative to the first member 71. The change member 70 changes the position of the restriction portion 67 in the up-down direction according to the distance between the first member 71 and the second member 72. The presser bar 8 is such that, in the first period, the adjustment portion 65 and the presser bar holder 82 contact and the urging force of the presser spring 81 is transmitted to the presser bar 8. In the first period is above the plate upper surface 27, and the adjustment portion 65 is separated from the restriction portion 67. In the second period, the adjustment portion 65 and the presser bar holder 82 are separated in the up-down direction, such that urging force from the presser spring 81 is not transmitted to the presser bar 8. In the second period, the feed dog upper end 18 is beneath the plate upper surface 27, and the adjustment portion 65 contacts with the restriction portion 67.

With the sewing machine 1, the user can adjust the timing for switching whether the urging force of the presser spring 81 is to be transmitted to the presser bar 8 or not by the relatively simple operation of changing the distance between the first member 71 and the second member 72. Therefore, the sewing machine 1 contributes to making the operation of adjusting, according to the sewing object C, the timing for changing the urging force applied to the presser foot 5 mounted to the lower end 98 of the presser bar 8 in synchronization with the rotation of the sewing machine motor 2, easier than it is with the known art.

The sewing machine 1 includes the adjustment spring 84 that is arranged below the adjustment portion 65 and urges the presser bar 8 downward via the presser bar holder 82 at least in the second period. The urging force of the adjustment spring 84 is less than the urging force of the presser spring 81. The adjustment spring 84 of the sewing machine 1 contributes to urging the presser foot 5 that is attached to the lower end 98 of the presser bar 8 downward by the urging force of the adjustment spring 84 that is less than the urging force of the presser spring 81 at least in the second period. Therefore, the sewing machine 1 contributes to realizing stable sewing by eliminating the period during which urging force is not fully applied to the presser foot 5.

The first member 71 has the first surface 51 that extends horizontally orthogonal to the up-down direction. The second member 72 has the second surface 52 that extends horizontally and faces the first surface 51. The change member 70 changes the position of the restriction portion 67 in the up-down direction according to the distance in the up-down direction between the first surface 51 and the second surface 52. The first member 71 and the second member 72 of the sewing machine 1 contribute to facilitating the operation of adjusting the distance between the first surface 51 and the second surface 52 according to the sewing object C, compared to when the first surface 51 and the second surface 52 are surfaces that extend in the up-down direction.

The second member 72 is configured to move in the up-down direction. The position of the first member 71 in the up-down direction is a fixed position. The sewing machine 1 contributes to making the operation of adjusting, according to the sewing object C, the timing for changing the urging force applied to the presser foot 5 arranged on the lower end 98 of the presser bar 8 in synchronization with the rotation of the sewing machine motor 2, a relatively simple operation of moving the position of the first member 71 in the up-down direction.

The restriction portion 67 is configured to move in the up-down direction according to the movement of the second member 72 in the up-down direction. The sewing machine 1 contributes to making the operation of adjusting, according to the sewing object C, the timing for changing the urging force applied to the presser foot 5 arranged on the lower end 98 of the presser bar 8 in synchronization with the rotation of the sewing machine motor 2, a relatively simple operation of moving the position of the second member 72 in the up-down direction.

The second surface 52 is the lower surface of the second member 72 and has a larger surface area than the upper surface 54 of the second member 72. The second member 72 of the sewing machine 1 contributes to making it easier for the user to check the position of the second surface 52, and making it easier to adjust the distance between the first surface 51 and the second surface 52, compared to when the surface area of the second surface 52 and equal to or less than the surface area of the upper surface 54 of the second member 72.

The change member 70 has the change shaft 66 that extends parallel to the presser bar 8 and is connected to the restriction portion 67. The second member 72 is disposed so as to be able to rotate relative to the change shaft 66. The restriction portion 67 is configured to move in the up-down direction together with the change shaft 66 in response to rotation of the second member 72. The second member 72 and the change shaft 66 of the sewing machine 1 contribute to making the configuration of the change member 70 relatively simple.

The hole 55 through which the change shaft 66 is inserted is arranged in the second member 72. The sewing machine 1 includes the first stopper 45 and the second stopper 46. The first stopper 45 is inserted through the change shaft 66 below the second member 72. The second stopper 46 is fixed above the first stopper 45 and squeezes, together with the first stopper 45, the second member 72. As a result, the second stopper 46 fixes the second member 72 with respect to the change shaft 66 in the up-down direction. The first stopper 45 and the second stopper 46 of the sewing machine 1 contribute to realizing, by a relatively simple configuration, a configuration that enables the second member 72 to rotate relative to the change shaft 66, while fixing the position of the second member 72 in the up-down direction with respect to the change shaft 66.

The sewing machine 1 includes the contact portion 69 arranged on the change shaft 66. The first member 71 has the contact-receiving portion 73 with which the contact portion 69 contacts. The contact-receiving portion 73 is configured to change the position of the restriction portion 67 in the up-down direction by changing the contact position where the contact portion 69 contacts with the contact-receiving portion 73. The contact portion 69 and the contact-receiving portion 73 of the sewing machine 1 contribute to realizing, by a relatively simple configuration, a configuration that moves the restriction portion 67 in the up-down direction together with the change shaft 66, in response to rotation of the second member 72.

The sewing machine 1 includes the cover 17 that covers the sewing machine motor 2. The first surface 51 and the second member 72 are exposed outside the cover 17. The cover 17 of the sewing machine 1 contributes to making it easier to perform the work of adjusting the distance between the first surface 51 and the second surface 52 according to the sewing object C, compared to when the first surface 51 and the second member 72 are arranged inside the cover 17. With the sewing machine 1, it is possible to easily adjust the distance between the first surface 51 and the second surface 52 depending on the thickness of the sewing object C by squeezing the sewing object C between the first surface 51 and the second surface 52. The first surface 51 of the present embodiment extends horizontally, and the vertical position of the first surface 51 is the same as the vertical position of the upper surface of the cover 17. Therefore, the first surface 51 of the present embodiment contributes to making it easier for the user to perform the work of squeezing the sewing object C between the first surface 51 and the second surface 52, compared to when the vertical position of the first surface 51 is different from the vertical position of the upper surface of the cover 17.

One rotation of the sewing machine motor 2 causes the needle bar 31 to move back and forth once in the up-down direction. The sewing machine 1 contributes to simplifying the configuration for adjusting, according to the sewing object C, the timing for changing the urging force applied to the presser foot 5, compared to a sewing machine in which the bar moves back and forth in the up-down direction not one time per rotation of the motor.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below:

The sewing machine of the present disclosure is not limited to the above-described embodiment; various modifications may be made within the scope of the present disclosure. For example, the following modifications may be made as appropriate.

The configurations of the sewing machine 1 and the presser device 9 may be modified as appropriate. The sewing machine 1 may be an industrial sewing machine. The conveyance direction of the sewing object C by the sewing machine 1 may be modified as appropriate. The number of times the needle bar 31 moves back and forth in the up-down direction as the motor makes one rotation may be changed as appropriate.

The type and arrangement and the like of the presser spring 81 and the adjustment spring 84 may be changed as appropriate. Both the presser spring 81 and the adjustment spring 84 need not be placed around the presser bar 8. The lower end portion of the adjustment spring 84 need not be housed in the housing portion 85. The second length L2 in the up-down direction of the adjustment spring 84 in its most compressed state may be greater than the first length L1. The adjustment spring 84 may also be omitted. The adjustment spring 84 need only be able to urge the presser bar 8 downward via the presser bar holder 82 at least in the second period. The configuration of the adjustment mechanism 68 may be modified as appropriate.

The configuration of the change member 70 may be modified as appropriate. A first member may have a first surface that extends in the vertical direction, and a second member may have a second surface that faces the first surface of the first member and extends in the vertical direction. In this case, a change member may include a conversion member such as a rack-and-pinion gear, a bevel gear, or a worm gear and a worm wheel. The conversion member may convert the horizontal movement of the first member and the second member to movement in the up-down direction, and thereby move the restriction portion 67 in the up-down direction. The position of the second member 72 in the up-down direction may be a fixed position. The first member 71 arranged below the second member 72 may be able to move in the up-down direction. In this case, the change shaft 66, the contact portion 69, and the contact-receiving portion 73 may be omitted, and the restriction portion 67 may move in the up-down direction in response to the movement of the first member 71 in the up-down direction.

The change member 70 may include the change shaft 66 as the second member, and the second member 72 may be omitted. In this case, the user may move the restriction portion 67 to a vertical position according to the thickness of the sewing object C by rotating the first member 71 around the change shaft 66 while the sewing object C is placed on the first surface 51, and adjusting the position of the upper surface of the sewing object C to a predetermined position of the change shaft 66. The predetermined position need only be set as appropriate. The predetermined position may be, for example, a vertical position where the upper end of the change shaft 66 is at the same position as the upper surface of the sewing object C. The predetermined position may be a position where the first stopper 45 that is inserted through the change shaft 66 contacts with the upper surface of the sewing object C. When changing the distance between the first member 71 and the second member 72, the user need not necessarily arrange the sewing object C between the first surface 51 and the second surface 52. For example, when the user sets the distance between the first member 71 and the second member 72 to a distance according to the sewing object C of a known thickness, the user may measure and adjust the distance between the first member 71 and the second member 72 of the sewing machine 1. The user may also adjust the distance between the first member 71 and the second member 72 of the sewing machine 1 while referencing scale marks arranged on the change member 70.

The change member 70 may include a cam surface that guides an contact portion fixed to the change shaft 66. The change member 70 may have a contact portion formed by a cam surface and a cam groove or the like on the change shaft 66, and the change member 70 may include a cam, as a contact-receiving portion, with which the contact portion of the change shaft 66 contacts. The change member 70 may have a configuration other than the contact portion and the contact-receiving portion. For example, the change member 70 may include a pinion, and a rack that is fixed to the change shaft 66 and in mesh with the pinion. Other than having a dial shape, the change member 70 may be a lever or the like. The configuration of the restricting member 75 that restricts rotation of the change member 70 may be modified as appropriate according to the configuration of the change member 70. The arrangement of the change member 70 with respect to the presser bar 8 may be modified as appropriate. The change member 70 is preferably arranged in a location where it is easy for the user to operate, and in a position where it will not interfere with sewing operations.

The second surface 52 need not have a surface area larger than that of the upper surface 54 of the second member 72. The change shaft 66 may be omitted, or need not extend parallel to the presser bar 8. The second member 72 need not have the hole 55 through which the change shaft 66 is inserted and need not be arranged so as to be able to rotate relative to the change shaft 66. In the sewing machine 1, at least one selected from a group of the first stopper 45 and the second stopper 46, that is to say, either the first stopper 45 or the second stopper 46, or both, may be omitted. The second member 72 need not be squeezed by the first stopper 45 and the second stopper 46. The first surface 51 and the second member 72 need not be exposed outside the cover 17. The upper surface of the cover 17 may serve as a substitute for the first surface 51 of the first member 71, and the first surface 51 of the first member 71 that is separate from the cover 17 may be omitted.

The shape of the adjustment portion 65 need not be a crank shape but may be modified as appropriate. For example, the shape of the adjustment portion 65 may be a flat plate shape, a cuboid shape, or a spherical shape. With the adjustment portion 65, the shape of at least one selected from a group of the first wall 61 to the fourth wall 64 may be modified, or at least one selected from a group of the first wall 61 to the fourth wall 64 may be omitted as appropriate. The configuration for changing the position of the restriction portion 67 in the up-down direction may be modified as appropriate. The housing portion 85 of the presser bar holder 82 may be omitted. The second length L2 may be greater than the first length L1.

What is claimed is:

1. A sewing machine comprising:

a sewing machine motor;

a needle bar having a lower end on which a sewing needle is mountable, the needle bar being configured to be driven by the sewing machine motor to move in an up-down direction;

a needle plate having a plate upper surface, a needle hole, and an opening, the plate upper surface being an upper surface of the needle plate, the sewing needle being configured to pass through the needle hole;

a feed dog configured to be driven by the sewing machine motor to move in the up-down direction through the opening to feed a sewing object placed on the needle plate, the feed dog having a feed dog upper end, the feed dog upper end being an upper end of the feed dog;

a presser bar having a lower end on which a presser foot is mountable, the presser bar being configured to move in the up-down direction in synchronization with movement of the feed dog;

a presser bar holder fixed to the presser bar;

an adjustment portion configured to move in the up-down direction;

a presser spring configured to urge the presser bar downward via the adjustment portion and the presser bar holder;

a restriction portion configured to restrict transmission of urging force from the presser spring to the presser bar when the restriction portion contacts with the adjustment portion; and a change member having a first member, and a second member supported to be movable with respect to the first member, the change member being configured to change a position of the restriction portion in the up-down direction according to a distance between the first member and the second member, wherein, in a first period in which the feed dog upper end is above the plate upper surface and the adjustment portion is spaced apart from the restriction portion, the adjustment portion contacts with the presser bar holder to cause the urging force of the presser spring to be transmitted to the presser bar, and wherein, in a second period in which the feed dog upper end is beneath the plate upper surface and the adjustment portion contacts with the restriction portion, the adjustment portion is spaced apart from the presser bar holder in the up-down direction to prevent the urging force of the presser spring from being transmitted to the presser bar.

2. The sewing machine according to claim 1, further comprising:

an adjustment spring arranged below the adjustment portion, the adjustment spring being configured to urge the presser bar downward via the presser bar holder at least in the second period, wherein the urging force of the adjustment spring is less than the urging force of the presser spring.

3. The sewing machine according to claim 1, wherein the first member has a first surface extending in a horizontal direction orthogonal to the up-down direction, the second member has a second surface, the second surface extending in the horizontal direction, and the second surface facing the first surface, and the change member is configured to change the position of the restriction portion in the up-down direction according to the distance between the first surface and the second surface in the up-down direction.

4. The sewing machine according to claim 3, wherein the second member is configured to move in the up-down direction, and a position of the first member in the up-down direction is a fixed position.

5. The sewing machine according to claim 4, wherein the restriction portion is configured to move in the up-down direction in response to movement of the second member in the up-down direction.

6. The sewing machine according to claim 5, wherein the second surface is a lower surface of the second member and has a larger surface area than an upper surface of the second member.

7. The sewing machine according to claim 3, wherein the change member has a change shaft, the change shaft extending parallel to the presser bar, and the change shaft connecting to the restriction portion, the second member is arranged rotatable with respect to the change shaft, and the restriction portion is configured to move in the up-down direction together with the change shaft in response to rotation of the second member.

8. The sewing machine according to claim 7, wherein the second member has a hole through which the change shaft is inserted, the sewing machine further comprising:

a first stopper through which the change shaft is inserted, below the second member; and a second stopper fixed higher than the first stopper, and the first stopper and the second stopper being configured to squeeze the second member to fix, in the up-down direction, the second member with respect to the change shaft.

9. The sewing machine according to claim 8, further comprising:

a contact portion arranged on the change shaft, wherein the first member has a contact-receiving portion with which the contact portion is configured to contact, the contact-receiving portion being configured to change the position of the restriction portion in the up-down direction by changing a contact position where the contact portion contacts with the contact-receiving portion.

10. The sewing machine according to claim 3, further comprising:

a cover that covers the sewing machine motor, wherein the first surface and the second member are exposed outside the cover.

11. The sewing machine according to claim 1, wherein one rotation of the sewing machine motor causes the needle bar to move back and forth once in the up-down direction.

* * * * *